United States Patent [19]

Hirt

[11] Patent Number: 4,960,166

[45] Date of Patent: Oct. 2, 1990

[54] ROTARY HEAT WHEEL STRUCTURE AND METHOD

[75] Inventor: John H. Hirt, Fullerton, Calif.

[73] Assignee: Hirt Combustion Engineers, Montebello, Calif.

[21] Appl. No.: 387,539

[22] Filed: Jul. 31, 1989

[51] Int. Cl.[5] ..... F28D 19/04

[52] U.S. Cl. ..... 165/9; 165/8; 165/10

[58] Field of Search ..... 165/10, 9, 8

[56] References Cited

U.S. PATENT DOCUMENTS 2,946,573 7/1960 Lindhagen et al. ..... 165/10
3,545,532 12/1970 Waitbus ..... 165/10

FOREIGN PATENT DOCUMENTS 676573 7/1952 United Kingdom ..... 165/9
2129533 5/1984 United Kingdom ..... 165/9

*Primary Examiner*—Albert W. Davis, Jr.
*Attorney, Agent, or Firm*—Poms, Smith, Lande & Rose

[57] ABSTRACT

A rotary heat wheel structure for a rotary heat exchanger in which a rotating wheel is provided with heat exchange material and rotates within a wheel housing to continuously cross an inlet path of low pressure cooler gas and an outlet path of high pressure hotter gasses for pre-heating the gas in the inlet path for utilizing the heat in the burned gasses before discharge to atmosphere. The wheel housing encloses the periphery of the wheel and is also provided with housing pillars defining an inlet path opening and an outlet path opening through which the rotary wheel rotates. Interior surfaces of the housing pillars are provided with radially extending grooves which co-act with opposite side faces of the rotary wheel to provide turbulence between the wheel side faces and the pillar surfaces so that leakage of gasses from the outlet path to the inlet path in the wheel housing is reduced.

2 Claims, 3 Drawing Sheets

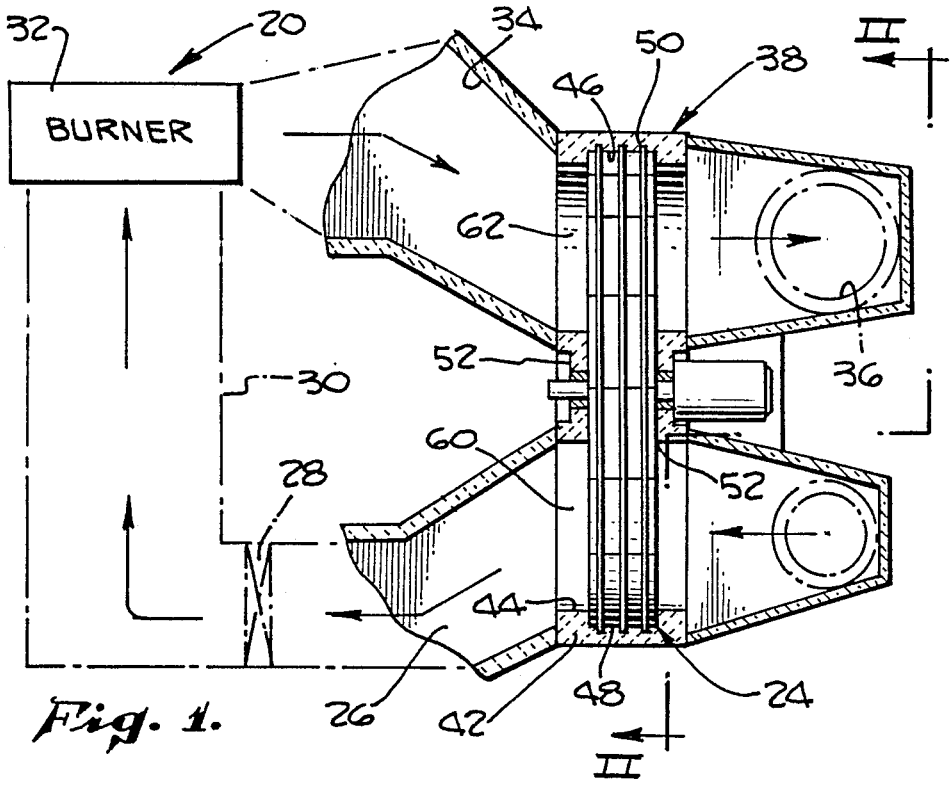
Fig. 1.
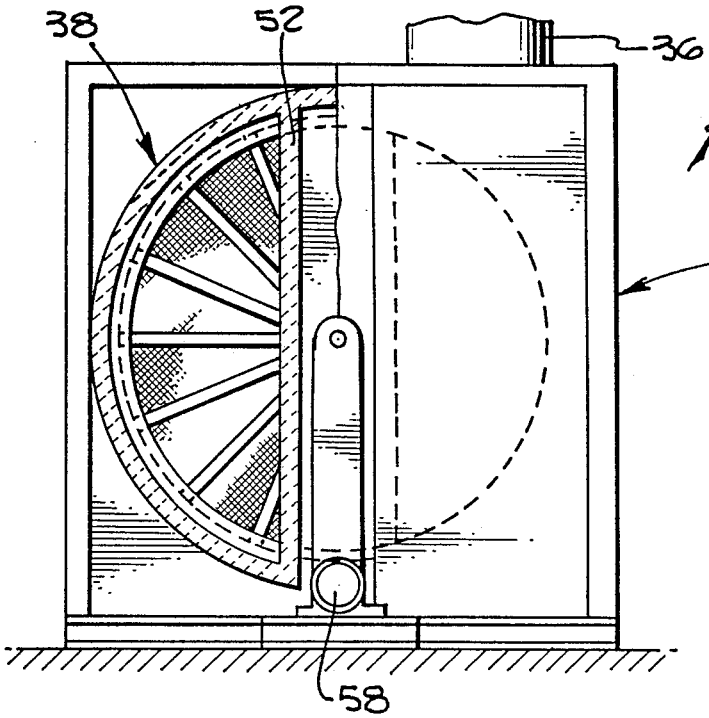
Fig. 2.
Fig. 10.
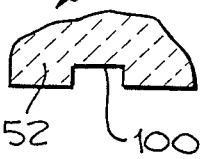

ROTARY HEAT WHEEL STRUCTURE AND METHOD

BACKGROUND OF THE INVENTION

Rotary heat exchangers or rotary regenerative heat exchange apparatus of axial flow type and in which a heat exchange wheel rotates in a plane and within a wheel housing providing almost 180° sectors for inlet and outlet flow paths for gasses present difficulties in sealing between adjacent opposed side surfaces of the rotating heat exchange wheel and faces of the housing pillars which define the almost 180° sectors of the inlet and outlet flow paths. Leakage of gasses from the outlet path to the inlet path tend to occur because of the high temperature of the outlet path and relatively higher pressure therein as compared to the cooler gasses and lower pressure in the inlet path. Any leakage of gasses between wheel housing surfaces and rotary wheel surfaces reduces the efficiency and effectiveness of the heat exchange function. Outlet or discharge gasses from a fume incinerator or burner means, which are passed through the outlet flow path, heat the heat exchange material of a sector of the rotary wheel before discharge of the outlet gasses into a waste stack. The heated exchange material of that sector of the wheel upon rotation to the inlet path side of the housing will be in heated condition to exchange heat to the cooler inlet gasses. The cooler inlet gasses will absorb heat from that sector of the rotary wheel which has just been rotated from the outlet path to pre-heat the inlet gasses before feeding into an incinerator, furnace or other heating means.

It will be apparent that a rotary heat exchange wheel rotating as above described will be subject to expansion and contraction both axially, radially and circumferentially due to its metallic design. Sealing between adjacent surfaces of the wheel and wheel housing and between the inlet and outlet paths to prevent passage of gasses or a substantial restriction of such leakage flow presents numerous problems because of the variable stressing of the wheel and its reaction to widely varying temperatures in relatively short time cycles. For example, at the cool side face of the rotary wheel, gasses may enter the inlet passage at an ambient temperature of 70° F. On the hot outlet side of the rotary wheel, the temperatures of the gasses after burning and approaching the wheel may be as high as 1,400° F or more. The response or reaction of the wheel structure and wheel housing to such a thermal differential range within its 360° circumference creates repetitive thermal stresses of expansion and contraction in the wheel and wheel housing components which render sealing and the effective efficient operation of the rotary heat exchange apparatus difficult.

Prior proposed heat exchange rotary wheel constructions have included various means for preventing passage or leakage of gasses between adjacent surfaces of the wheel housing and the rotary wheel. Prior examples of such sealing means include a peripheral inwardly extending rib on the wheel housing for engagement with sealing material such as felt carried on the outer circumferential edge face of the wheel in a humidity changer for air conditioning (U.S. Pat. No. 3,398,510). Interleaved flanges and ribs on a horizontally disposed wheel at the top circumferential edges of the wheel and housing is shown in U.S. Pat. No. 2,744,731. Circumferential rim seals of a flexible flange type are shown in U.S. Pat. No. 3,482,622 and packing elements at the circumferential rim are shown in U.S. Pat. No. 4,062,129. Various other prior proposed constructions have been used for preventing leakage through clearance openings between a wheel housing and the enclosed rotating wheel.

In a hot-cool temperature environment as generally mentioned above for the rotary heat exchange wheel of the present invention, the rotary wheel is subjected to varying repetitive expansion and contraction as each sector thereof moves from the discharge path in which the hot side of the wheel may be subject to temperatures in the order of 1,400° or more to the cool side of the wheel where at the inlet path temperatures may be ambient such as 70° F. While the wheel rotates relatively slowly, for example 16 RPM, it will be readily apparent that thermal stresses imposed upon the wheel structure cause expansion and contraction of wheel components axially, radially, and circumferentially. Complete sealing of leakage areas around the periphery of the wheel and at the hub of the wheel is difficult because of the thermal conditions. Moreover, on the hot side face of the wheel, the pressure differential between the inlet path and the outlet path may vary up to one to six inches of water column and, therefore, leakage flow would occur from the high pressure side to the low pressure side. Such leakage flow lessens and detracts from efficient use of the wheel heat exchange material which is to absorb as much heat as possible from the outlet path as the wheel sectors pass through the outlet path and then transfer to the inlet gas flow such absorbed heat at the inlet path so that the inlet flow of gasses will be pre-heated. The fuel cost of operation of the burner or incinerator means is effectively reduced by supplying pre-heated gas or air.

SUMMARY OF THE INVENTION

The present invention relates to a rotary heat exchanger for use in a high temperature environment wherein means for restricting and reducing leakage of gasses between surfaces of the rotatable wheel heat exchanger and the wheel housing is provided in novel effective manner.

A general subject of the invention is to provide a rotary heat exchanger wheel capable of efficiently and effectively absorbing heat from hot gasses on an outlet or discharge side of the housing and transferring such heat to ambient inlet gasses passing through the wheel on the inlet side of the housing.

Another object of the invention is to provide a rotary heat exchanger wherein the rotary heat exchange wheel is constructed to readily adapt to varying thermal conditions while maintaining substantial dimensional integrity to provide substantially non leakage conditions between the inlet and outlet flow paths of the gasses.

Another object of the invention is to provide a rotary heat exchanger which may be readily and easily maintained.

A still further object of the invention is to provide a rotary heat exchanger in which communication or flow of gasses between the hot and cool sectors of the rotary wheel through passageways between the wheel and the wheel housing is restricted to a minimum.

A specific object of the invention is to provide means for restricting the leakage flow of gasses between the hot and cold sides of the wheel and between the cool inlet and hot outlet passageways by providing interrupt means on the opposed interior faces of the pillars of the wheel housing, said interrupt means causing turbulence in the gasses attempting to leak from one side to the other so that the leakage of gasses is reduced.

The invention contemplates a method of reducing leakage of gasses between a high pressure hot outlet path and a low pressure cool inlet path by causing turbulence as wheel sides pass in close proximity to pillar surfaces of the wheel housing.

Various other objects and advantages of the present invention will be readily apparent from the following description of the drawings in which an exemplary embodiment of the invention is shown.

IN THE DRAWINGS

FIG. 1 is a fragmentary sectional view, partially schematic, showing an incinerator or burning system embodying the present invention relating to a rotary wheel heat exchange means.

FIG. 2 is an elevational view partly in section taken from the planes indicated by the lines II—II of FIG. 1.

FIG. 10 is an enlarged side view of a groove in the housing pillar.

DETAILED DESCRIPTION OF INVENTION

Figure 3:
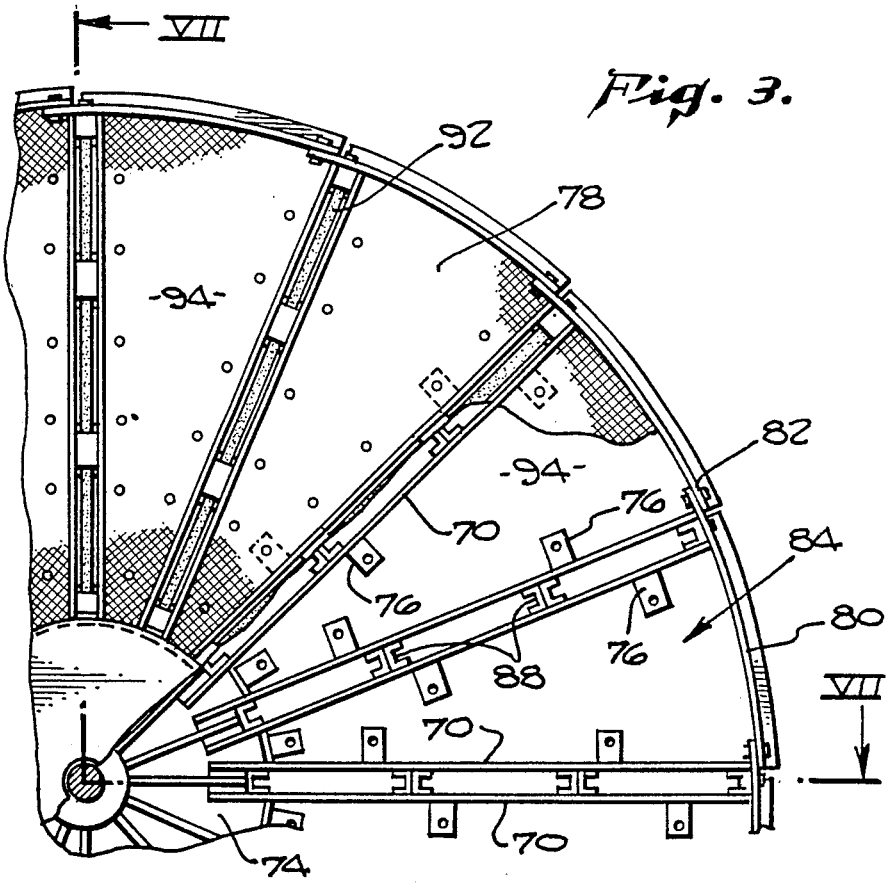
FIG. 3 is a fragmentary view of a quadrant of the rotary wheel shown in FIG. 1, certain sectors of the wheel being shown filled with compressed heat exchange material and certain other sectors being shown without the heat exchange material to better show the construction of the wheel.

In FIG. 1, a burner system generally indicated at 20 is schematically illustrated and receives effluent, fume gasses or fluid material to be burned through an inlet duct 22 which passes such fluid material through semicircular sectors of a heat exchange wheel 24 and into a duct 26 provided with a fan 28 for drawing the material to be thermally oxidized through the ducts 22 and 26 and then into a feed duct 30 which leads to the burner or incinerator means 32. Burner means 32 discharges oxidized gasses or material into a duct 34 which passes the burned gasses through opposite semicircular sectors of the heat exchange wheel 24 and into discharge duct 36 where non-polluting gasses are emitted into atmosphere. Fume gasses introduced through inlet 22 may be at ambient temperature and may contain organic material to be burned. At the inlet side, the gasses to be oxidized may be at relatively low pressure. When the gasses are passed through sectors of the heat exchange wheel 24, moving across the inlet passageway, the gasses are heated by the hot heat exchange material in the rotary wheel so that in inlet duct 26 the gasses may have been raised to a temperature in the order of about 1,200° F. This pre-heating of the gasses substantially reduces fuel costs in operating the incinerator system 32.

The oxidation process in burner means 32 elevates the temperature of discharged incinerated gasses to approximately 1,400° to 1,600° F. These hot gasses pass through discharge duct 34 and are directed to and through sectors of the heat exchange wheel 24 moving across the flow path of the hot gasses. The hot gasses heat the heat exchange material in the sectors of the rotary wheel and are then passed into discharge duct 36 for emission into atmosphere or other devices for further processing the gas, if necessary. At the discharge side of the above system, the pressures because of temperature and flow of the heated gasses at a flow rate of, for example, about 25,000 SCFM or higher are substantially greater than the pressures and heat of the inflowing gasses at the inlet ducts 22, 26.

Such a general system using a heat exchange wheel is known in the art but all of the problems associated with housing of the heat exchange wheel in a manner such that the heat exchange operation is highly effective and efficient at high temperatures and at high flow rates and pressures have not been solved. The presence of leakage from the hot discharge flow path of the incinerated gasses to the cool inflow path of the incoming gasses reduces the effectiveness and efficiency of the heat exchange process. An increase in the effectiveness and efficiency of the heat exchange process is highly desirable because of the substantial reduction in fuel costs of the burner system and the more effective oxidation of organic materials in the system.

It is also known to provide a wheel housing of heat resistant refractory material and to mount a rotary heat exchange wheel within said housing for rotation about an axis. The rotary wheel is preferably made of metal which is subject to thermal expansion and contraction. The thermal environment of the heat exchange wheel in the wheel housing and the repeated subjection of moving sectors of the wheel to extremely hot gasses and to cool gasses, causes severe thermal expansion and contraction of wheel components in axial, radial, and peripheral or circumferential directions. The side surface of the wheel which faces the burner system is subjected to temperatures ranging, as mentioned before, from 1,200° to 1,600° F. The wheel side surfaces facing the inlet and discharge ducts 22 and 36 are relatively cool because the sectors traveling across duct 22 may be receiving ambient cool inflowing gasses while the sectors of the wheel side surface facing discharge duct 22 are at a temperature much less than the opposite surface of the wheel because a large amount of heat has been absorbed by the large area and density of the heat exchange material. The presence of such a multidimensional thermal expansion and contraction of a wheel structure makes difficult the effective sealing of the spaces between surfaces of the wheel housing 38 and adjacent surfaces of the heat exchange wheel 24.

Figure 7:
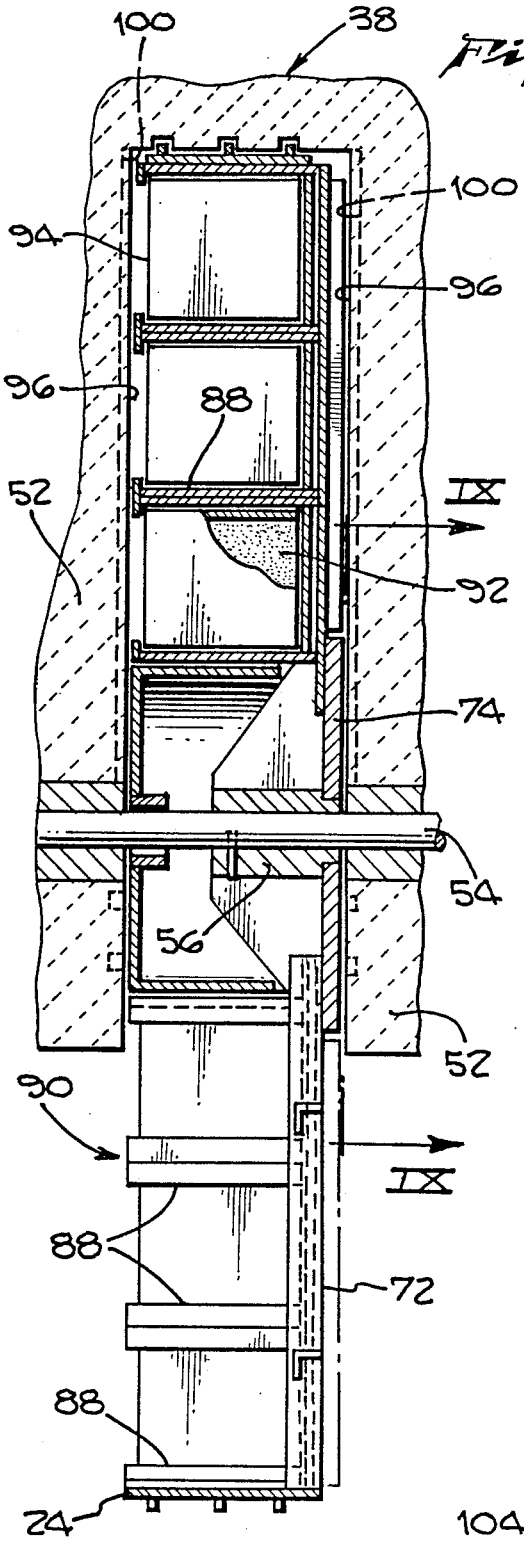
FIG. 7 is an enlarged view, partly in section, taken in vertical and horizontal planes as indicated by lines VII—VII of FIG. 3.

The wheel housing 38 is best viewed in FIGS. 1, 2, and 7. In FIG. 2, the wheel housing comprises an outer housing structure 38 of suitable material and within which is provided a cylindrical housing member 42 made of suitable ceramic refractory material or other non-porous minimal expanding material. The cylindrical housing member 42 provides an inner circumferential surface 44 which is interrupted by a peripheral recess 46 which receives circumferential margins of the rotary wheel 24. The recess 46 may be provided with circumferential or peripheral grooves 48 adapted to receive spaced circumferential ribs 50 on the periphery of the rotary wheel 24.

The wheel housing 38 includes diametrical spaced pillars 52. The spaced pillars 52 provide support for wheel drive shaft 54 which extends through hub means 56 of the wheel 24. Shaft 54 may be connected to a drive motor means 58 in any suitable, well-known manner.

Housing pillars 52 divide the wheel housing into two generally semi-circular openings one of which may be opening 60 providing a cool flow path for incoming gasses and the other of which may be an outlet path 62 for hot outwardly flowing burned gasses discharged from burner 32 and moving at a selected pressure and flow rate greater than that of the inflow of gasses through opening 60.

Briefly, the rotary heat exchange wheel comprises in addition to the hub means 56 and drive shaft 54 a wheel structure in which radially outwardly extending spokes 70 are disposed on the cool wheel side 72. Hub means 56 may carry a hub disk 74 to which radial inner ends of spokes 70 may be secured or attached in a known manner by welding to hub plate 74 or by suitable nut and bolt assemblies not shown. Each spoke 70 may comprise a channel section having a radially spaced lateral tabs 76 along opposite sides of the channel adapted for attachment of preformed compressed bodies 92 of heat exchange material 78. Outer ends of spokes 70 are interconnected by circumferentially arcuate shroud plates 80 which are overlapped as at 82 and secured by suitable nut and bolt assemblies. Spokes 70 and shroud plates 80 define arcuate sectors generally indicated at 84 for reception of similarly shaped bodies of heat exchange material 78.

The spokes and tabs are located on the cool side of the rotary wheel. The wheel construction includes sets of radially spaced angle sections 88, each set secured at one end to spokes 70 and arranged in back to back relation for rigidity and projecting parallel to the axis of shaft 54 toward the hot side 90 of the wheel. The space between radially adjacent sets of angle sections 88 may be filled with said preformed bodies 92 of heat exchange material having exposed irregular side surfaces 94 lying in proximity to interior surfaces 96 of the pillars 52 as the wheel rotates past pillar 52.

Figure 4:
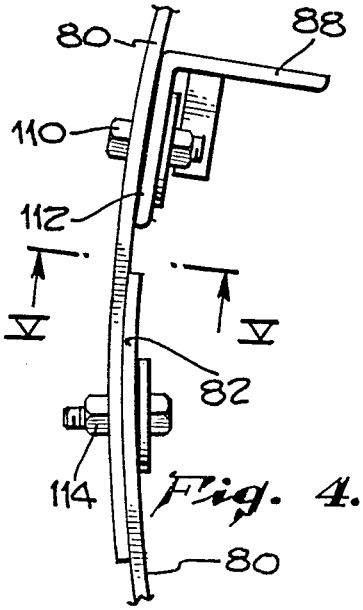
FIG. 4 is an enlarged fragmentary view of a portion of the periphery of the rotary wheel showing a shroud assembly.

The shroud Assembly shown in FIG. 4 is taken at the peripheral edge of the wheel on its hot side as indicated by phantom lines 4 FIG. 7 with the housing removed. Each shroud plate 80 may be secured to the axially extending angle 88 by nut and bolt assemblies 110 passing through the shroud plate 80 and angle portion 112 of the angle section 88. As shown in FIG. 4, shroud plates 80 are overlapped as at 82 and a securement nut and bolt assembly 114 may be provided at the overlapped portions. The assembly at the overlapping portions at 82 together with the retaining nut and bolt assemblies 114 may be provided relatively large tolerances in a circumferential direction to permit relative movement of the shroud plates in expansion and contraction of the wheel.

Figure 5:
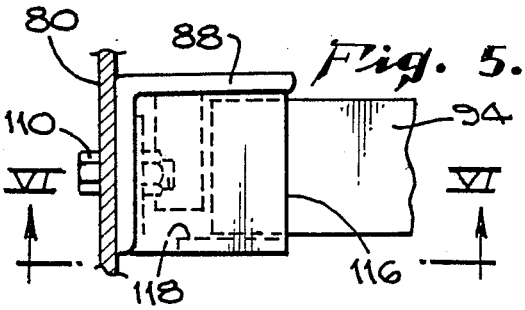
FIG. 5 is a fragmentary view, partly in section, taken in the plane indicated by line V—V of FIG. 4.
Figure 6:
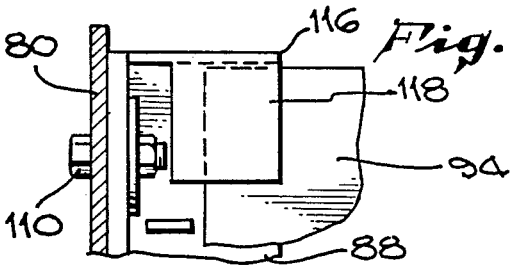
FIG. 6 is a fragmentary sectional view taken in the plane indicated by line VI—VI of FIG. 5.

In FIGS. 5 and 6, the assembly of the shroud plate 80 with the circumferential angle section 88 is illustrated with a retainer clip 116 of angle section and having a narrow angle leg 118 lying parallel to one of the edges of the heat exchange material 94 to assist in retention of the material in its sector.

In each of the sectors defined by the spokes 70 and the shroud plates 80 and extending from the area of the hub means 74 to the circumference of the wheel may be pie shaped sections or bodies 92 of heat exchange material. A preferred heat exchange material may comprise a body of closely packed stainless steel crimped wire filaments having a pie shaped configuration corresponding to the arcuate sector 84 defined by the spokes 70. The thickness of the body of the pie shaped section 92 corresponds to the thickness of the rotary wheel 24 and more specifically to the length of the back to back angle sections 88 which extend in an axial direction. The crimped steel filaments or needles may have a selected diameter between needles of 0.221 to 0.236 inches and provide diagonal corrugations which when packed and compressed uniformly throughout the area of the pie shaped section 92 provides a density of mesh which may be in the order of approximately 14 lbs. per cubic foot. One example of the amount of compression described is that of compressing a mesh pack of 15 inches to 10 inches.

Figure 8:
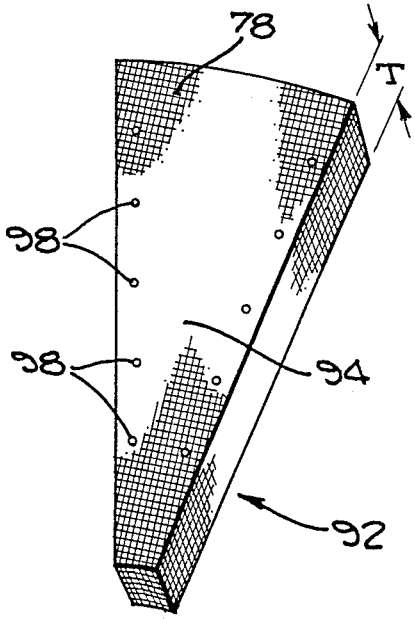
FIG. 8 is an enlarged view of a sector of compressed heat exchange material adapted to be mounted in the sectors of the wheel defined by the spokes and periphery thereof.
Figure 9:
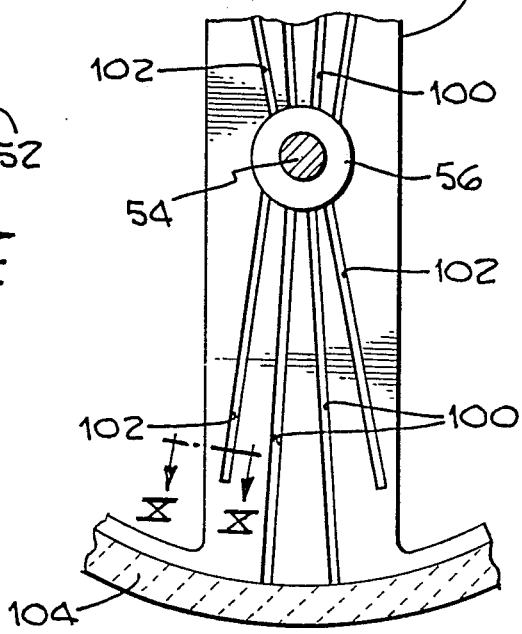
FIG. 9 is an enlarged fragmentary view taken in the plane indicated by line IX—IX of FIG. 7 and showing the arrangement of grooves in the interior face of a pillar of the wheel housing.

As indicated in FIG. 8 along radial margins of the pie-shaped section 92 are provided holes 98 which may receive security bolts which extend through the holes 98 and the thickness of the pie-shaped section 92 for securement to the tabs 78 provided on the spokes 70 at the cool side of the wheel 24. The arcuate sectors of the wheel when filled with pie-shaped sections 92 and with the heat exchange material 78 in the spoke arrangement provides a side surface of heat exchange material of annular form extending from the hub of the wheel to the circumference of the wheel and providing a selectively closely packed mesh or matrix of steel crimped filaments which have heat exchange contact with the burned gasses discharged from the burner. The selectively compressed and packed stainless steel crimped mesh bodies 92 permits passage therethrough of hot gasses while effectively absorbing heat from the hot gasses because of the magnitude of surface area provided by the numerous crimped filaments for exposure to the passing gasses. The large area per pound of wire mesh provides high absorption of heat at the outlet path and corresponding deabsorption of heat at the inlet path.

The hot and cold wheel side faces are thus provided with surfaces which are of uneven irregular character, that is, not smooth nor uniform but as provided by random, non parallel, multi directional distribution of the steel crimped filaments.

In accordance with this invention, the interior pillar surfaces 96 are provided with radially extending grooves 100 and 102 which extend from the hub means 56 outwardly toward the circumferential wall 104 of the wheel housing. In this example, grooves 100 extend entirely to wall 104 while the grooves 102 extend radially to a point spaced from the interior surface of wall 104 because the radial angle of grooves 102 approaches into proximity with the side edge of the pillar 52. Each groove 100 and 102 may be of selected depth and width. In this example, the width of each groove may be one inch and the depth of each groove may be one half inch. Each groove thus includes a width greater than its depth. The surfaces of pillar 52 between the grooves 100 and 102 may be provided with an unfinished surface on the ceramic refractory material of which the wheel housing and pillar is made. The unfinished interior surface of each pillar together with the interruption of such surface by the plurality of grooves 100 and 102 provides an interrupt means which coacts with the irregular surfaces of the hot and cool sides of the wheel to create turbulence in flow of gasses from the outlet side of the wheel housing towards the inlet side of the wheel housing.

The irregular side surfaces of the wheel are provided a selected proximate tolerance to the interior surfaces of the pillars. The pressure drop occurring between the outlet and inlet sides of the wheel housing is substantially changed because as the gasses are carried and flow from the outlet side through the wheel and also in the direction of the cool side so as to attempt to pass the pillars of the wheel housing the irregular side surfaces of the wheel and the dissipation of such leaking gasses into the channels 100 and 102, which have selected depth and width, tends to create an active disturbance and turbulence of gasses which results in a change in the pressure drop between the two sides (leakage occurring from clean gas back to dirty gas) and a resultant reduction in leakage of gasses between the hot and cold sides of the wheel housing.

The wheel construction described above including the change in pressure drop and reduction of leakage between the hot gas path and the cool gas path has resulted in an increased effectiveness of the heat exchange system of from 80% to approximately 90%. The increase in mesh bulk density and the particular type of crimped diagonal filament weave enhances the effectiveness of the heat transfer from the hot gasses to the heat exchange material and then to the cool gasses. Thus, the destruction by thermal oxidation of hydrocarbon material in air becomes more affordable and the rotary heat exchange wheel construction of this invention provides a practical solution to controlling effluent in paint spray booths or other low concentration organic laden gases not suitable for direct discharge to atmosphere without incurring greatly increased fuel costs.

It will be understood that various changes and modifications may be made in the wheel construction described above which come within the spirit of this invention and all such changes and modifications coming within the scope of the apended claims are embraced thereby.

What is claimed is:

1. A method of reducing fluid leakage losses in a rotary heat exchange wheel system in which a heat exchange wheel rotates across the low pressure low heat inflow fluid path and high pressure high temperature outflow fluid path provided in a wheel housing having a diametrical surface on said housing proximate to at least one side face of said wheel, comprising the steps of:

forming interrupt means in said diametrical surface extending transversely and longitudinally of said diametrical surface, said interrupt means being provided in the form of radially extending grooves in said diametrical surface, said grooves having a width greater than their depth;

moving sector shaped irregular faces of heat exchange material in proximity to and across said interrupt means as said wheel is rotated at a selected RPM;

said interrupt means and said irregular faces creating fluid turbulence and pressure drops between said housing diametrical surface and said one side of said wheel for minimizing fluid leakage between said inflow and outflow paths in said housing.

2. In a rotary wheel heat exchange apparatus including a wheel housing having a pair of diametrical housing pillars defining generally semi-circular openings in the wheel housing, one opening being for passage of hot gasses discharged under pressure from a burner means, and the other opening for passage of ambient or cool gasses under less pressure to be burned, said pillars including spaced opposed interior surfaces, a rotary heat exchange wheel including a hub means for receiving a drive shaft mounted in said housing pillars; the improvement comprising in combination:

a plurality of radial grooves in said pillar surfaces extending from said hub means toward said cylindrical wall, said grooves having widths much greater than the depths of said grooves to cause turbulence of gasses between said wheel surfaces and said pillars to reduce leakage between said semi-circular openings of hot gasses and cool gasses while said rotary wheel is being rotated.

* * * * *